US011566633B2

(12) United States Patent
Norwood et al.

(10) Patent No.: US 11,566,633 B2
(45) Date of Patent: Jan. 31, 2023

(54) CEILING FAN BLADE

(71) Applicant: Hunter Fan Company, Memphis, TN (US)

(72) Inventors: Bobby Neal Norwood, Oakland, TN (US); Charles William Botkin, Cordova, TN (US)

(73) Assignee: Hunter Fan Company, Memphis, TN (US)

( * ) Notice: Subject to any disclaimer, the term of this patent is extended or adjusted under 35 U.S.C. 154(b) by 0 days.

(21) Appl. No.: 17/400,222

(22) Filed: Aug. 12, 2021

(65) Prior Publication Data

US 2021/0372427 A1 Dec. 2, 2021

Related U.S. Application Data

(63) Continuation of application No. 16/458,333, filed on Jul. 1, 2019, now Pat. No. 11,111,930.

(60) Provisional application No. 62/695,863, filed on Jul. 10, 2018.

(51) Int. Cl.

| | |
|---|---|
| ***F04D 29/38*** | (2006.01) |
| ***F04D 29/34*** | (2006.01) |
| ***F04D 25/08*** | (2006.01) |

(52) U.S. Cl.

CPC ..... *F04D 29/384* (2013.01); *F04D 25/088* (2013.01); *F04D 29/34* (2013.01)

(58) Field of Classification Search

CPC combination set(s) only.

See application file for complete search history.

(56) References Cited

U.S. PATENT DOCUMENTS

| | | | |
|---|---|---|---|
| 2,008,957 | A | 7/1935 | Hueglin |
| 2,157,999 | A | 5/1939 | Charavay |
| 2,592,471 | A | 4/1952 | Sawyer |
| 2,682,925 | A | 7/1954 | Wosika |
| 2,918,977 | A | 12/1959 | Fedan et al. |
| 3,891,349 | A | 6/1975 | Woollenweber, Jr. |
| 4,046,489 | A | 9/1977 | Fairchild et al. |
| 4,275,993 | A | 6/1981 | Sprengling |
| 4,358,245 | A | 11/1982 | Gray |

(Continued)

FOREIGN PATENT DOCUMENTS

| | | | |
|---|---|---|---|
| CN | 202073834 | U | 12/2011 |
| CN | 202132275 | U | 2/2012 |

(Continued)

OTHER PUBLICATIONS ttps://www.myfan.com_au/ceiling-fans/loft/, Item specification for the Loft 60 Ceiling Fan Collection by Emerson—1 High Performance, 6 pages, item accessed on May 8, 2018.

(Continued)

*Primary Examiner* — Binh Q Tran

(74) *Attorney, Agent, or Firm* — McGarry Bair PC

(57) ABSTRACT

A ceiling fan or blade thereof can include a fan motor for rotating the blade. The blade can include an airfoil body having an outer surface extending between a leading edge and a trailing edge, and a root and a tip. The blade can be separated into three distinct cross sections including a first cross section as a lifting cross section, a second cross section as a flat cross section, and a third cross section as a transition section between the first and second cross sections.

23 Claims, 8 Drawing Sheets

(56) References Cited

U.S. PATENT DOCUMENTS

| | | | | |
|---|---|---|---|---|
| 4,662,819 | A | 5/1987 | Lakowske et al. | |
| 4,892,460 | A | 1/1990 | Volk | |
| 5,193,983 | A | 3/1993 | Shyu | |
| 5,222,864 | A * | 6/1993 | Pearce | F04D 25/088 248/344 |
| 5,230,850 | A | 7/1993 | Lewis | |
| 5,244,347 | A | 9/1993 | Gallivan et al. | |
| 5,330,323 | A | 7/1994 | Swanson | |
| 5,401,138 | A | 3/1995 | Mosiewicz | |
| 5,575,624 | A | 11/1996 | Bogage | |
| 5,681,145 | A | 10/1997 | Neely et al. | |
| 6,039,533 | A | 3/2000 | McCabe | |
| 6,039,541 | A | 3/2000 | Parker et al. | |
| 6,146,097 | A | 11/2000 | Bradt | |
| 6,183,201 | B1 | 2/2001 | Maby | |
| 6,244,821 | B1 | 6/2001 | Boyd et al. | |
| 6,250,886 | B1 | 6/2001 | Immell et al. | |
| 6,402,475 | B1 | 6/2002 | Chen | |
| 6,508,627 | B2 | 1/2003 | Gerken et al. | |
| 6,685,436 | B2 | 2/2004 | Huang | |
| 6,840,739 | B2 * | 1/2005 | Cortez | F04D 29/34 416/214 R |
| 6,884,034 | B1 | 4/2005 | Parker et al. | |
| 6,902,375 | B2 * | 6/2005 | Bird | F04D 29/34 416/207 |
| 7,210,910 | B1 | 5/2007 | Parker et al. | |
| 7,284,960 | B2 | 10/2007 | Aynsley | |
| 7,927,071 | B2 | 4/2011 | Parker et al. | |
| 8,066,480 | B2 | 11/2011 | Madsen | |
| 8,162,613 | B2 | 4/2012 | Oleson et al. | |
| 8,529,212 | B2 | 9/2013 | Smith et al. | |
| 8,579,588 | B1 | 11/2013 | Boyd | |
| 8,721,305 | B2 | 5/2014 | Oleson et al. | |
| 9,011,099 | B2 | 4/2015 | Wortman et al. | |
| 9,360,020 | B2 | 6/2016 | Janecek | |
| 9,523,371 | B2 | 12/2016 | Hollan et al. | |
| 9,546,665 | B2 | 1/2017 | Stull et al. | |
| 9,726,192 | B2 | 8/2017 | Whitley et al. | |
| 9,995,313 | B2 | 6/2018 | Yamashita et al. | |
| 2004/0253111 | A1 | 12/2004 | Harris | |
| 2007/0009364 | A1 * | 1/2007 | Huang | F04D 29/384 416/243 |
| 2007/0154315 | A1 * | 7/2007 | Bucher | F04D 29/601 416/210 R |
| 2009/0180888 | A1 * | 7/2009 | Parker | F04D 25/088 416/223 R |
| 2010/0054947 | A1 | 3/2010 | Chen | |
| 2010/0054948 | A1 * | 3/2010 | Chen | F04D 25/088 416/223 R |
| 2010/0104461 | A1 * | 4/2010 | Smith | F04D 25/088 416/223 R |
| 2012/0128501 | A1 * | 5/2012 | Hoofard | F04D 29/384 416/223 R |
| 2014/0044548 | A1 | 2/2014 | Wang | |

FOREIGN PATENT DOCUMENTS

| | | | |
|---|---|---|---|
| CN | 202646153 | U | 1/2013 |
| CN | 103410777 | A | 11/2013 |
| CN | 104169587 | A | 11/2014 |
| CN | 205078498 | U | 3/2016 |
| CN | 205243900 | U | 5/2016 |
| CN | 206845502 | U | 1/2018 |
| CN | 107676300 | A | 2/2018 |
| EP | 3292086 | B1 | 7/1991 |
| EP | 3612073 | A1 | 8/1994 |
| EP | 1173359 | B1 | 5/2004 |
| EP | 1205668 | B1 | 2/2007 |
| EP | 1588024 | B1 | 4/2010 |
| EP | 2397783 | A1 | 12/2011 |
| EP | 2397784 | A1 | 12/2011 |
| EP | 2761169 | B1 | 3/2016 |
| EP | 1619392 | B1 | 1/2017 |
| IN | 201731045349 | A | 1/2018 |
| JP | 2007170292 | A | 7/2007 |
| KR | 101331103 | B1 | 11/2013 |
| TW | 279748 | U | 11/2005 |
| WO | 2017164586 | A1 | 9/2017 |

OTHER PUBLICATIONS http://www.multi-wing net/blade-profiles/airfoil-fan-blades/. Item specification for Airfoil Fan Blades, 2 pages, item accessed on May 8, 2018.

http://www.multi-wing net/downloads/, Item specification for Multi-Wing pdf brochure downloads, 2 pages, item accessed on May 8, 2018.

* cited by examiner

CEILING FAN BLADE

CROSS-REFERENCE TO RELATED APPLICATION(S)

This application is a continuation of U.S. patent application Ser. No. 16/458,333, filed on Jul. 1, 2019, now U.S. Pat. No. 11,111,930, issued Sep. 7, 2021, which claims priority to and the benefit of U.S. Provisional Patent Application No. 62/695,863, filed on Jul. 10, 2018, which is incorporated herein by reference in its entirety.

BACKGROUND

Ceiling fans are machines typically suspended from a structure for moving a volume of air about an area. The ceiling fan includes a motor, with a rotor and stator, suspended from and electrically coupled to the structure. A set of blades mount to the rotor such that the blades are rotatably driven by the rotor, and can be provided at an angled orientation to move volume of air about the area. As the cost of energy becomes increasingly important, there is a need to improve the efficiency at which the ceiling fans operate.

BRIEF DESCRIPTION

In one aspect, the disclosure relates to a blade driven by a ceiling fan having a fan motor, the blade comprising: a body extending between a leading edge and a trailing edge to define a chord-wise direction, and extending between a root and a tip to define a span-wise direction, with the body including an upper surface and a lower surface; wherein the body comprises at least two distinct cross sections including a first cross section having a flat lower surface with an airfoil cross section and a second cross section comprising the flat lower surface and a flat upper surface.

In another aspect, the disclosure relates to a blade for a ceiling fan comprising: a body including an upper surface and a lower surface, wherein the airfoil body comprises a first cross section with a flat lower surface with an airfoil cross section and a second cross section with a flat upper surface and the flat lower surface.

In yet another aspect, the disclosure relates to a ceiling fan assembly comprising: a motor; a blade rotatably driven by the motor, the blade including an airfoil body having an outer surface extending between a leading edge and a trailing edge to define a chord-wise direction, extending between a root and a tip to define a span-wise direction, and separating the outer surface into an upper surface and a lower surface; wherein the airfoil body comprises a first cross section comprising an airfoil cross section and a second cross section comprising a flat upper surface and a flat lower surface.

DETAILED DESCRIPTION

Figure 1:
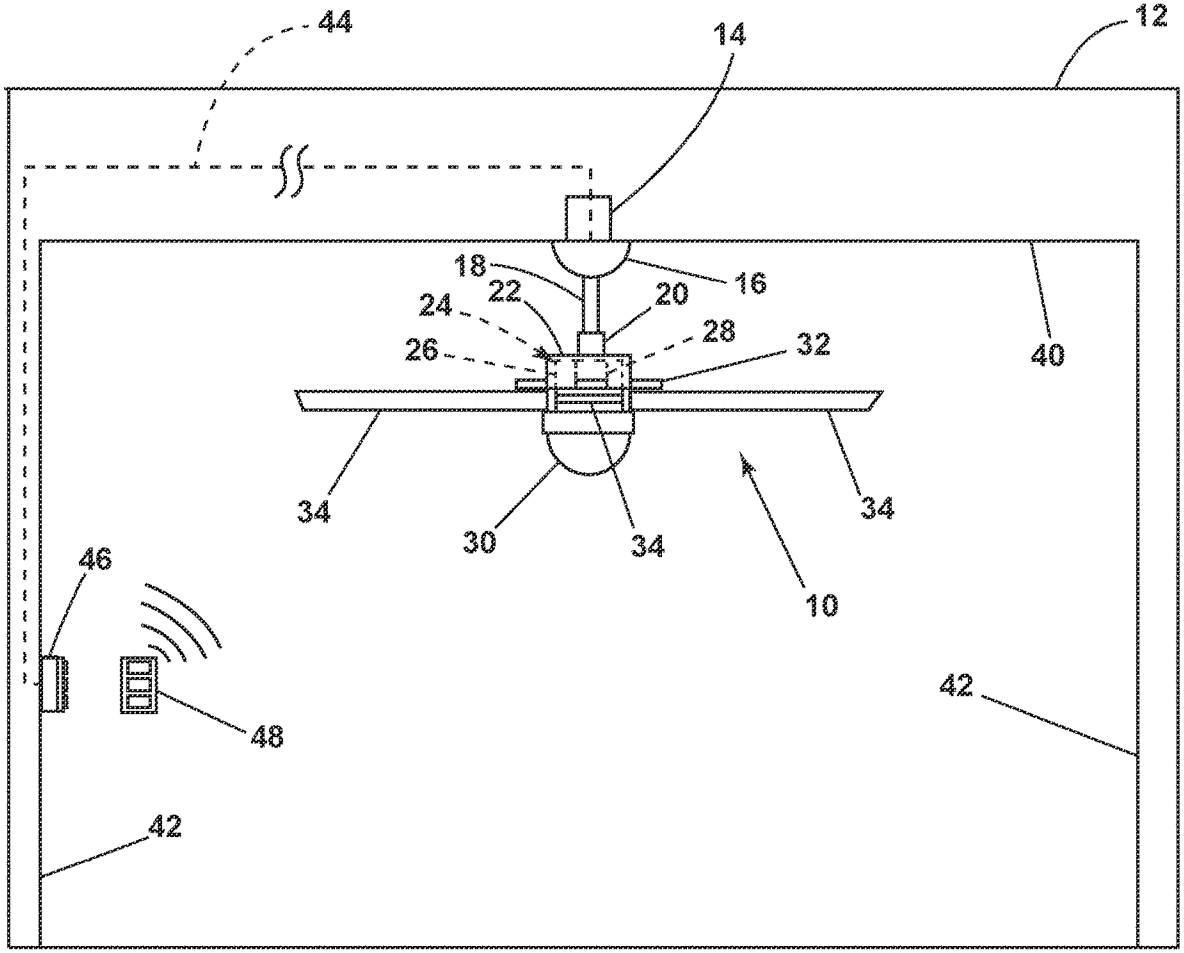
FIG. 1 is a schematic view of a structure with a ceiling fan including a set of blades suspended from the structure.

The disclosure is related to a ceiling fan and ceiling fan blade, which can be used, for example, in in residential and commercial applications. Such applications can be indoors, outdoors, or both. While this description is primarily directed toward a residential ceiling fan, it is also applicable to any environment utilizing fans or for cooling areas utilizing air movement.

As used herein, the term "set" or a "set" of elements can be any number of elements, including only one. All directional references (e.g., radial, axial, proximal, distal, upper, lower, upward, downward, left, right, lateral, front, back, top, bottom, above, below, vertical, horizontal, clockwise, counterclockwise, upstream, downstream, forward, aft, etc.) are only used for identification purposes to aid the reader's understanding of the present disclosure, and do not create limitations, particularly as to the position, orientation, or use of aspects of the disclosure described herein. Connection references (e.g., attached, coupled, connected, and joined) are to be construed broadly and can include intermediate members between a collection of elements and relative movement between elements unless otherwise indicated. As such, connection references do not necessarily infer that two elements are directly connected and in fixed relation to one another. The exemplary drawings are for purposes of illustration only and the dimensions, positions, order and relative sizes reflected in the drawings attached hereto can vary.

Referring now to FIG. 1, a ceiling fan 10 is suspended from a structure 12. In non-limiting examples, the ceiling fan 10 can include one or more ceiling fan components including a hanger bracket 14, canopy 16, a downrod 18, a motor adapter 20, a motor housing 22 at least partially encasing a motor 24 having a rotor 26 and a stator 28, a light kit 30, and a set of blade irons 32. In additional non-limiting examples, the ceiling fan 10 can include one or more of a controller, a wireless receiver, a ball mount, a hanger ball, a light glass, a light cage, a spindle, a finial, a switch housing, blade forks, blade tips or blade caps, or other ceiling fan components. A set of blades 34 can extend radially from the ceiling fan 10, and can be rotatable to drive a volume of fluid such as air. The blades 34 can be operably coupled to the motor 24 at the rotor 26. The blades 34 can include a set of blades 34, having any number of blades, including only one blade.

The structure 12 can include an exemplary ceiling 40 from which the ceiling fan 10 is suspended, and a set of walls 42. It should be understood that the structure 12 is schematically shown and is by way of example only, and can include any suitable building, structure, home, business, or other environment wherein moving air with a ceiling fan is suitable or desirable. An electrical supply 44 can be provided in the structure 12, and can electrically couple to the ceiling fan 10 to provide electrical power to the ceiling fan 10 and the motor 24 therein. It is also contemplated that the electrical supply be sourced from somewhere other than the structure 12, such as a battery or generator in non-limiting examples.

A wired controller 46 can be electrically coupled to the electrical supply 44 to control operation of the ceiling fan 10 via the electrical supply 44. Similarly, the wired controller 46 can be communicatively coupled to the ceiling fan 10, configured to control operation of the ceiling fan 10. Non-limiting examples of controls for the ceiling fan 10 can include fan speed, fan direction, or light operation. Furthermore, a wireless controller 48, alone or in addition to the wired controller 46, can be communicatively coupled to a controller or a wireless receiver in the ceiling fan 10 to control operation of the ceiling fan 10. It is further contemplated in one alternative example that the ceiling fan be operated by the wireless controller alone 48, and is not operably coupled with the wired controller 46.

Figure 2:
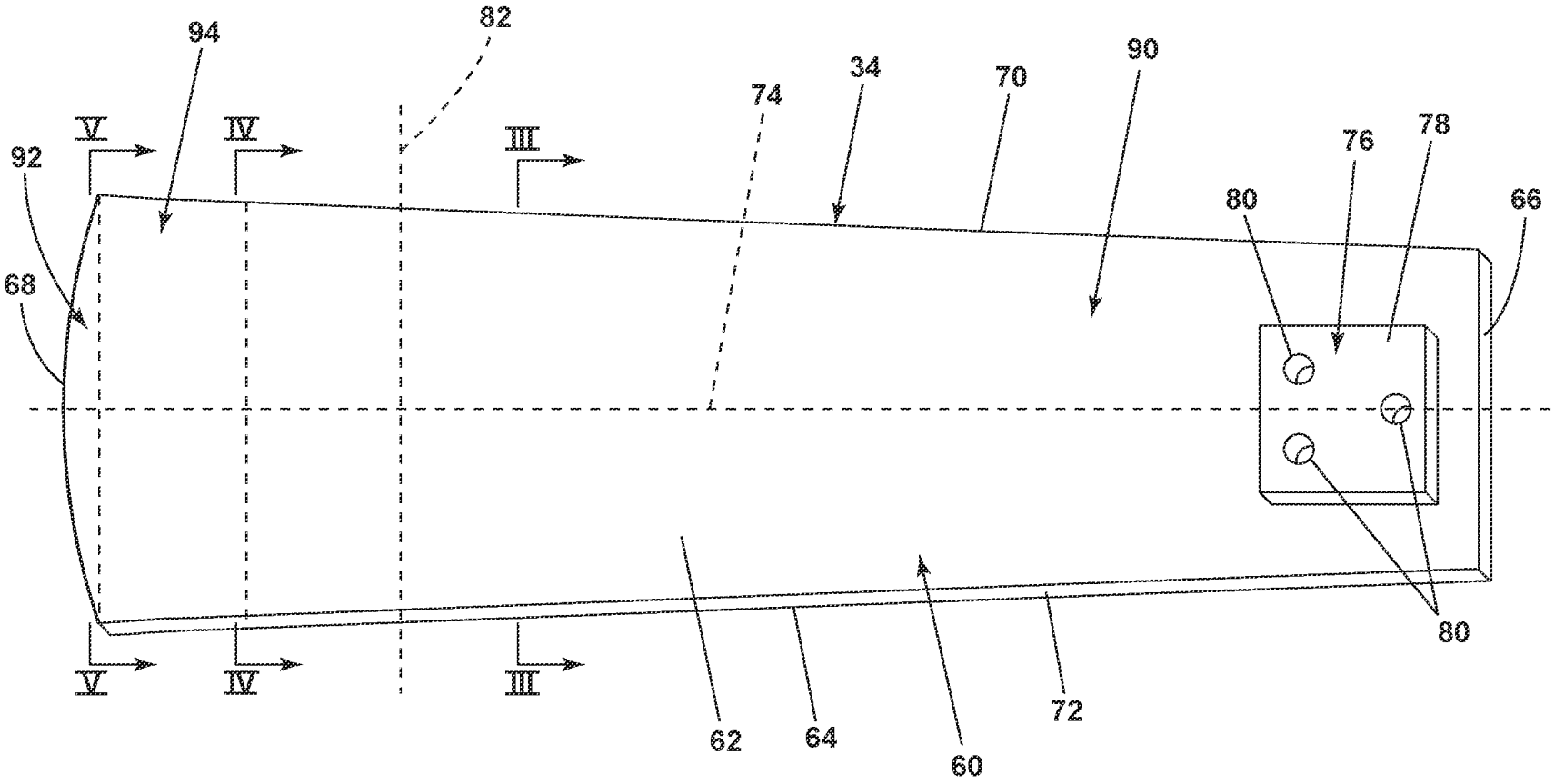
FIG. 2 is a top view of one blade from the set of blades or FIG. 1 having different sections as a first section, a second section, and a third section as illustrated by separating lines.

Referring now to FIG. 2, a single fan blade 34 includes a body 60 with a first upper surface 62 and a second lower surface 64, a root 66 and a tip 68, and extends between a first side edge 70 and a second side edge 72, which can be a leading edge and a trailing edge, for example, depending on the direction of rotation of the blade. In one example, the upper surface 62 can face the ceiling 40, while the lower surface 64 can face a floor of a structure 12. The tip 68 can includes a front surface between the first upper surface 62 and the second lower surface 64, having a convex shape, for example. The root 66 can be proximate the motor 24 when mounted to the ceiling fan 10, while the tip 68 can be distal. The root 66 can have a rear surface between the first upper surface 62 and the second lower surface 64 that is flat, for example. The tip 68 has a greater or longer chord than the root 66, such that the chord length increases between the first and second side edge 70, 72, and can be increasing continuously from the root 66 to the tip 68. In one example, the rate of increase of the chord length can be constant. A span-wise axis 74 can be defined extending between the root 66 and the tip 68 defining a span-wise direction. In one non-limiting example, the span-wise axis 74 can be defined equidistant between the first side edge 70 and the second side edge 72 extending between the root 66 and the tip 68. A chord-wise axis 82 can define a chord-wise direction extending between the first side edge 70 and the second side edge 72, and can be arranged orthogonal to the span-wise axis 74, for example. In one example, the body 60 can increase in length measured along the chord-wise axis 74, such that the blade widens extending from the root 66 to the tip 68. In other examples, the chord length can vary along the span-wise axis 74, such that it is variable, continuously increasing, or continuously decreasing.

A blade iron mount 76 can mount to and extend from the first upper surface 62, and can include a flat mount surface 78. In non-limiting examples, the blade iron mount 76 can be a gasket and can be made of a substantially rigid material suitable for mounting the blade 34 to the motor 24, while simultaneously dampening vibrations between the blade 34 and the motor 24, such as foams, neoprenes, rubbers, polymers, polyurethane, elastics, composites, or plastics in non-limiting examples. A set of mount apertures 80, shown as three mount apertures 80, can be provided in the mount surface 78. The set of mount apertures 80 can be threaded, in one example, configured to threadably receive a fastener such as a screw to fasten the blade 34 to the motor 24.

The blade 34 can be separated into a first section 90 having a first cross section or profile, a second section 92 having a second cross section or profile, and a third section 94 having a third cross section or profile. In one example, the first section 90 can be symmetrical, such as about the span-wise or chord-wise axes 74, 82. The first section 90 can be positioned at and extend from the root 66, extending toward the tip 68 along the span-wise axis 74.

The second section 92 can be arranged at the tip 68, extending toward the root 66. In one non-limiting example, the second section 92, having the second profile with the flat lower surface 64 and the flat upper surface 62 can be located only at the tip 68, with only the tip 68 including the flat upper and lower surfaces 62, 64. Alternatively, it is contemplated that the second section 92 occupies a larger span-wise portion of the blade 34.

Figure 3:
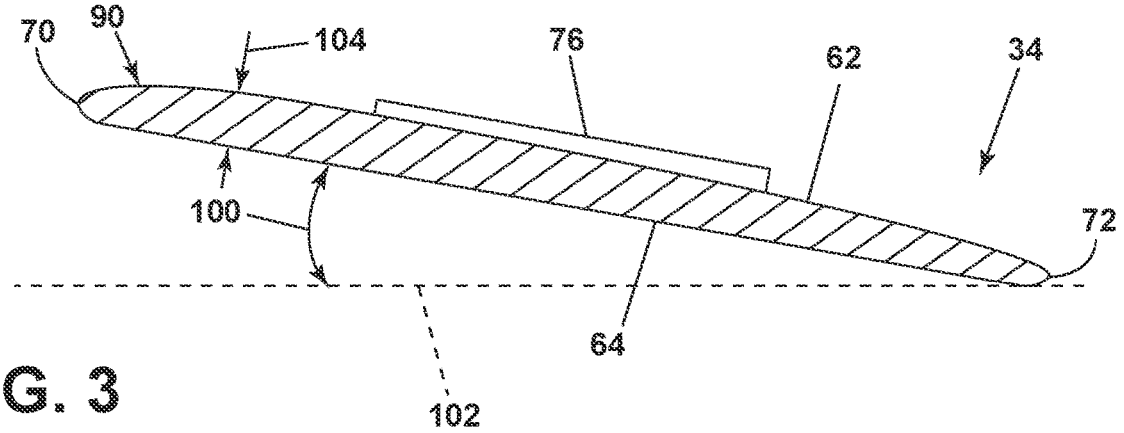
FIG. 3 is a sectional view of the first section of the blade of FIG. 2 taken along section III-III.

Referring now to FIG. 3, taken across section III-III of FIG. 2, a cross section of the first section 90 includes the airfoil profile shown as a flat bottom airfoil, including the flat second lower surface 64, and an asymmetric, convex, first upper surface 62. The first section 90 can include a first maximum thickness 104 for the airfoil profile of the first section 90, defined between the first upper surface 62 and the second lower surface 64 along the first section 90, which can be measured orthogonal to the first upper surface 62, the second lower surface 64, or both, for example, or can be measured relative to a chord-line defined by the airfoil cross section. It should be appreciated that a thickness between the first upper surface 62 and the second lower surface 64 can vary between the first side edge 70 and the second side edge 72, due to the airfoil cross-sectional shape, or that the first maximum thickness 104 an be positioned differently than that shown based upon the particular shape of the airfoil cross section.

The first section 90 can include a cross section that can be a lifting cross section or an airfoil cross section. The lifting cross section or airfoil cross section can be any cross section or profile that is shaped to generate lift in at least one direction of rotation, for example, and can include any airfoil cross-sectional shape such as a flat bottom airfoil, a symmetrical airfoil, a semi-symmetrical airfoil, an under-camber airfoil, in non-limiting examples, or any other airfoil shape, such as those having an early camber, a late camber, no camber, a varying or constant thickness, a large or small thickness, or any other suitable aerodynamic airfoil feature forming the lifting cross section. Such aerodynamic airfoil features can be any such feature that is adapted to increase operational efficiency of the ceiling fan 10 due to the profile reducing aerodynamic drag or turbulence, utilizing Bernoulli's Principle, or increasing boundary layer attachment along at least a portion of the first upper surface 62 or the second lower surface 64 in non-limiting examples.

It should be appreciated while the flat bottom airfoil shape of the first section 90 includes a generally low camber, any camber is contemplated, such as a deep camber or any camber therebetween. Furthermore, while not shown it is contemplated that the camber can include a small or large thickness, or can optionally include a reflex trailing edge.

The blade 34 can be oriented at an angle of attack 100, with the blade 34 arranged at an angle relative to the horizontal 102, such that the second lower surface 64 is offset from the horizontal where the lower surface 64 confronts the air during rotation of the blade 34. Arranging the blade 34 at the angle of attack 100 can move a volume of air during rotational movement of the fan blade 34.

Figure 4:
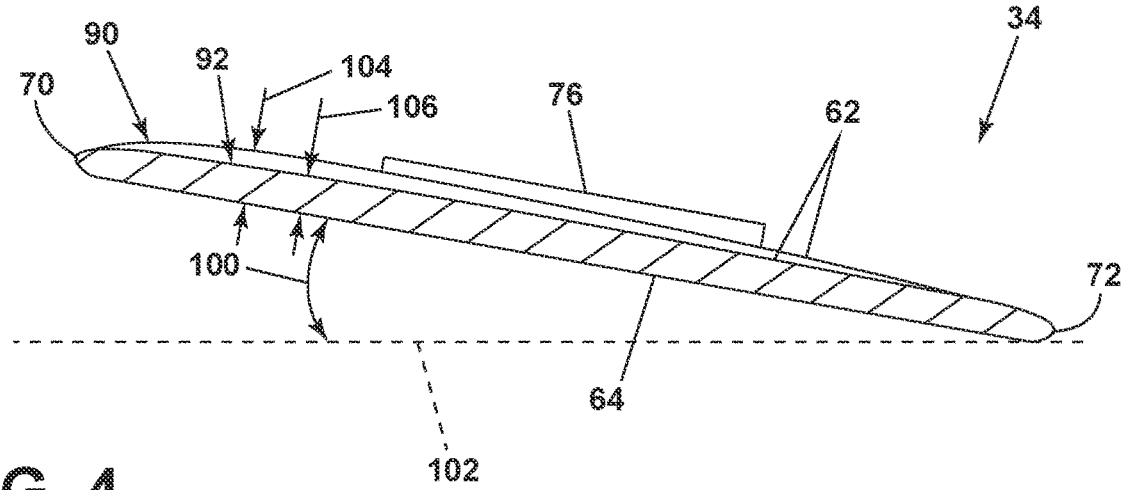
FIG. 4 is a sectional view of the second section of the blade of FIG. 2 taken along section IV-IV.

Referring now to FIG. 4, taken across section IV-IV of FIG. 2, the second section 92 includes a cross section or profile with a flat first upper surface 62 and a flat second lower surface 64. A second maximum thickness 106 can be defined between the first upper surface 62 and the second lower surface 64 at the second section 92. The second maximum thickness 106 can be measured orthogonal to the first upper surface 62, the second lower surface 64, or both, for example. The thickness can be constant along most of the second section 92, as the first upper surface 62 and the second lower surface 64 can be flat and parallel to one another, with the exception that the first and second side edges 70, 72 are radiused, providing a curved transition between the upper surface 62 and the lower surface 64. The second maximum thickness 106 can be less than that of the first maximum thickness 104, as is appreciable, such that the aerodynamic airfoil shape of the first section 90 provides for an increased thickness as opposed to that of the second section 92 including the flat upper and lower surfaces 62, 64. It should be appreciated that the first section 90, having the greater first maximum thickness 104, is visible behind the second section 92 in FIG. 4.

Additionally, the blade 34 at the second section 92 can be arranged at the angle of attack 100, while it is contemplated that the second section 92 may not be arranged at the angle of attack 100 or a different angle of attack 100 than that of the first section 90. In another non-limiting example, the angle of attack 100 can vary along the span-wise axis 74, best shown in FIG. 14.

Figure 5:
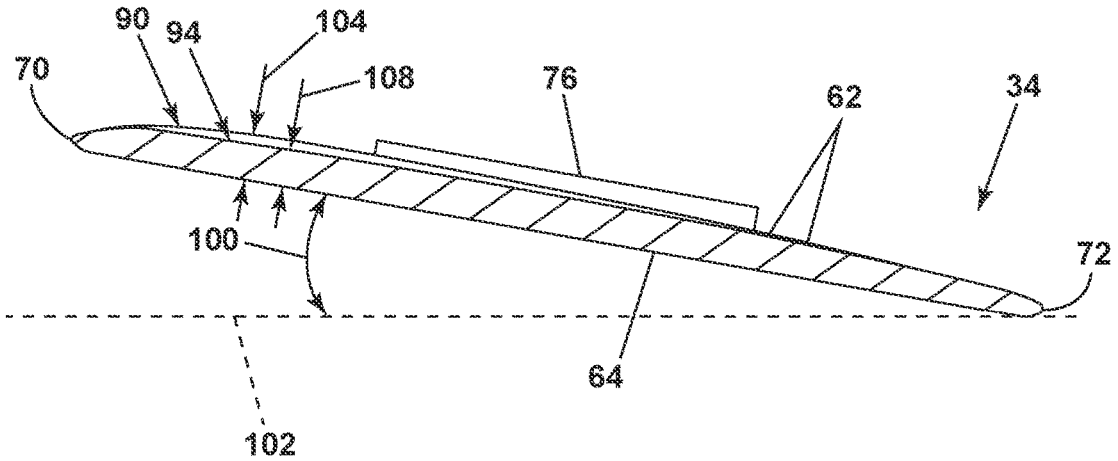
FIG. 5 is a sectional view of the third section of the blade of FIG. 2 taken along section V-V.

Referring now to FIG. 5, taken across section V-V of FIG. 2, the third section 94 includes a transition section that transitions from the first section 90 to the second section 92. The third section 94 can include a third maximum thickness 108, that is less than the first maximum thickness 104 of FIG. 3, but greater than the second thickness 106 of FIG. 4, resultant of the transition between the first section 90 and the second section 92. The third maximum thickness 108 can be measured orthogonal to the first upper surface 62, the second lower surface 64, or both, for example. The first section 90 is visible behind the third section 94, as is appreciable in FIG. 5. The thickness along the airfoil cross section of the third section 94 can vary, resultant of the shape of the airfoil cross section. It should be appreciated that the third section 94 includes an airfoil shape with a lesser camber than that of the first section 90, as it transitions to the second section 92 with no camber.

At the tip 68, the blade 34 includes both the flat upper surface 62 and the flat lower surface 64, with the flat lower surface 64 extending fully along the span of the blade 34. Thus, when the user views the blade 34 from the bottom or the tip 68 looking along the blade 34, the airfoil shape is not seen nor readily recognized. Furthermore the second section 92 in combination with the flat second lower surface 64 of the first section 90, provides for a traditional aesthetic with an unadorned bottom surface 64 for the fan blade 34 as it transitions to the airfoil section 90, which is preferable to the consumer, where an entire fan blade having the airfoil cross section does not. The third section 94 provides for a smooth transition between the first and second sections 90, 92, which reduces aerodynamic losses while providing an aesthetically pleasing look to the consumer between the first and second sections 90, 92.

Figure 6:
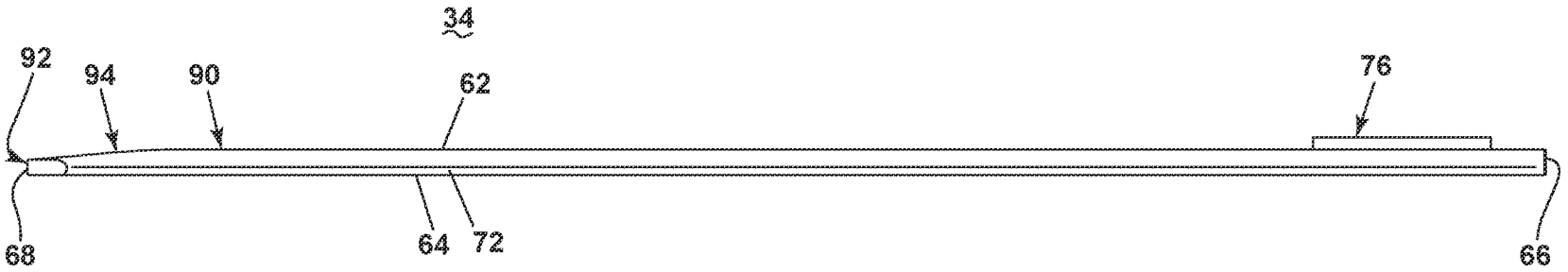
FIG. 6 is a side view of the blade better showing the first section of FIG. 3, the second section of FIG. 4, and the third section of FIG. 5.

Referring now to FIG. 6, the first section 90 can extend from the root 66 to the tip 68 for at least 80% of the span, for example, or can be about 90% or 95% of the span, in other non-limiting examples, or any value between 80% span and 95% span. It should be appreciated that the first section 90 can occupy lesser portions of the span than those portions as described, such as less than 80% span or greater than 95% span.

The second section 92 can be about 3-10% or 5-10% of the span, extending along the span-wise axis 74, in non-limiting examples. It should be appreciated that other ranges or sizes for the second section are contemplated, such as those less than 3% span or greater than 10% span, for example. In one example, the second section 92 can be symmetrical along the chord-wise axis 82. The third section 94 can be positioned between the first and second sections 90, 92 and can transition from the first section 90 to the second section 92. The third section 94 can include a remaining portion of the blade 34 unoccupied by the first and second sections 90, 92, such as between 5-15% span in one non-limiting example. It should be appreciated that other ranges or sizes for the thirds section 94 are contemplated, such as less than 5% span or greater than 15% span, for example.

Figure 7:
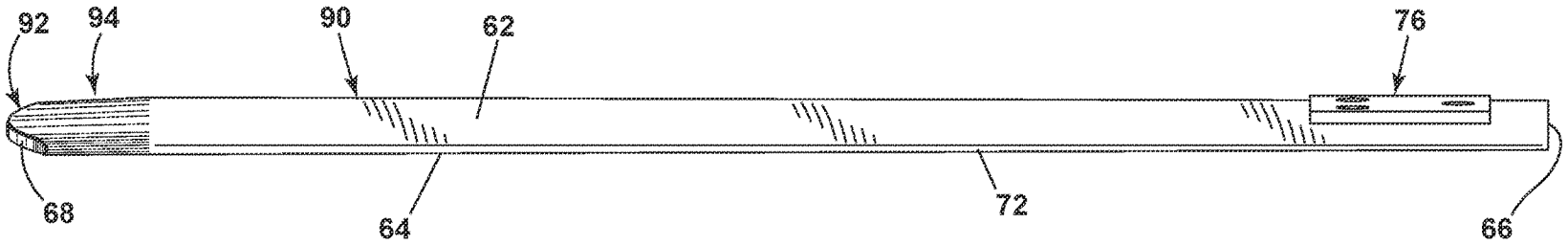
FIG. 7 is a perspective side view of the blade depicting the contours of the first section of FIG. 3, the second section of FIG. 4, and the third section of FIG. 5.

Referring now to FIG. 7, the blade 34 can include different contours for the different sections 90, 92, 94. For example, the airfoil profile for the first section 90 can include a convex, rounded surface for the upper surface 62. The third section 94, transitioning between the first section 90 and the second section 92, can include a slight taper for the upper surface 62, relative to the plane parallel to the flat lower surface 64. Furthermore, the upper surface 62 at the third section 94 can include a convex curve to transition between the first and second section 90, 92. Alternatively, it is contemplated that the upper surface 62 of the third section 94 can be concave, flat, linear, discrete, step-wise, or any variation thereof suitable for transitioning between the first and second sections 90, 92.

In operation, the lifting or airfoil cross section of the first section 90 generates an increased downward force imparted to the air passing along the blade 34, which can be the result of the lift generated by the blade shape. The increased downward force increases the overall volume of air moved by the fan blade, as opposed to a blade without the lifting or airfoil cross section of the first section 90. Utilizing the angle of attack 100 in combination with the lifting or airfoil cross section can further increase the overall volume of air moved by the fan blade 34, while requiring a lesser overall energy cost relative to the flow volume generated by the blades 34, as opposed to a traditional fan blade that is flat along the entire length of the blade. Thus, the blade 34 as described provides for aerodynamic and efficiency improvements along the first section 90 of the blade 34. In one example, such an airfoil shape can provide for an increase in overall performance measured in total flow volume by 30% or more. In one example, the blade 34 can provide a 7%-40% increase in maximum air velocity, as opposed to a blade having an upper and lower surface that are both flat along the extent of the blade. Additionally, increases in maximum air velocity greater than 40% are possible. Similarly, the blade 34 can provide an increase in flow volume of 5% to 35%, as opposed to a blade having a wholly flat upper and lower surface. Additional increases in flow volume greater than 35% are possible.

Figure 8:
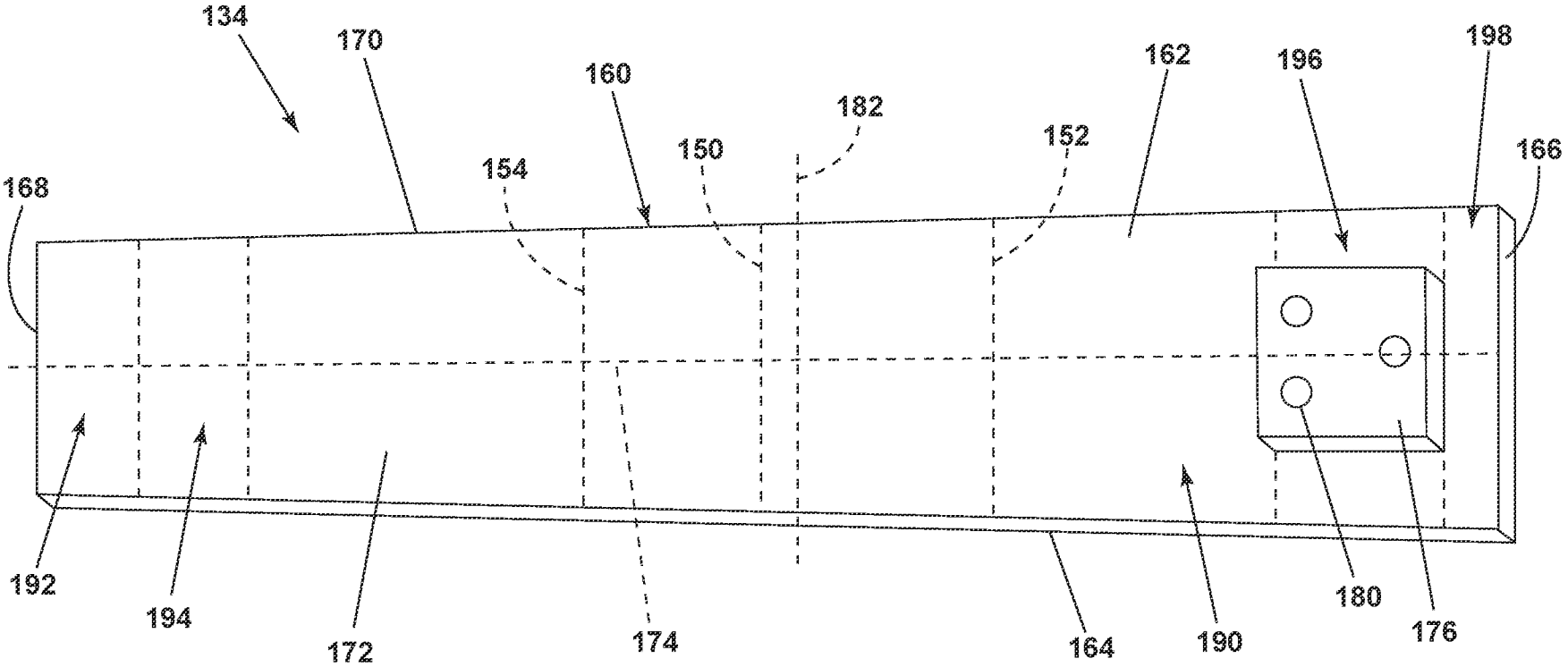
FIG. 8 is a top view of a fan blade having five exemplary sections as illustrated by separating lines.

Referring now to FIG. 8, an alternate blade 134 having five different sections 190, 192, 194, 196, 198, having two transition sections 194, 196, as opposed to the three sections 90, 92, 94 and the single transition section 94 of FIG. 2. The blade 134, similar to that of FIG. 2, can include a body 160 including a first upper surface 162 and a second lower surface 164 extending between a root 166 and a tip 168 to define a span-wise axis 174. A first side edge 170 and a second side edge 172, such as a leading edge and a trailing edge, can extend from the root 166 to the tip 168 between the first upper surface 162 and the second lower surface 164. A span-wise axis 174 can be defined extending between the root 166 and the tip 168, and can be arranged equidistant from the first and second side edges 170, 172, for example.

A chord-wise 182 direction can be defined extending between the first and second side edges 170, 172, orthogonal to the span-wise axis 174 and anywhere along the blade 134. As shown, the root 166 is longer than the tip 168 in the chord-wise direction, such that the body 160 includes a decreasing width extending toward the tip 168, measured in the chord-wise direction. Alternatively, the blade 134 can have a constant chord along the length of the blade 134, or a changing chord, such as having a constant rate of change for the chord extending between the root and the tip. Furthermore, any variation of the chord is contemplated as defining the geometry of the blade, such as a constant, varying, step-wise, unique, or non-constant variation of the width of the blade measure in the chord-wise direction. Alternatively, it is contemplated that the body 160 can include any blade shape, such as geometric, squared, rectangular, triangular, rounded, unique, variable, converging, diverging, widening, thinning, or thickening in non-limiting examples. While the root 166 and the tip 168 are shown as flat linear portions, the root 166 or tip 168, or both, can be flat, linear, rounded, curved, arcuate, concave, convex, sinusoidal, stepped, jagged, unique, variable, or any combination thereof in non-limiting examples, such that a myriad of shapes for the root 166 and the tip 168 are contemplated. Similarly, a myriad of geometries or shapes for the first and second side edge 170, 172 are contemplated, such as linear, flat, rounded, curved, arcuate, concave, convex, sinusoidal, stepped, jagged, unique, or variable, or any combination thereof, in non-limiting examples. Where the shapes for the first or second side edges 170, 172 are non-linear, or non-uniform among the edges 170, 172, the span-wise axis 174 can be non-linear. Therefore, it should be appreciated that a wide variety of different blade shapes are contemplated. A blade iron mount 176, which can be a gasket, can mount to the body 160 on the first upper surface 162, and can be substantially similar to the blade iron mount 76 as described in FIG. 2, including a set of mount apertures 180.

The body 160 can be separated into five sections, including the first three sections as a first section 190, a second section 192, and a third section 194, which can be substantially similar to the first section 90, the second section 92, and the third section 94 of FIG. 2, for example.

The third section 194 can begin or end halfway between the root 166 and the tip 168, or at 50% span-wise distance 150 relative to the span-wise axis 174. In such an example, either the first section 190 or the second section 192 can cover 50% of the blade in the span-wise direction. The third section 194 can cover 5-15% of the blade 134, or lesser mounts such as 5%, 2%, or 1% in non-limiting examples, while it is contemplated that the third section 194 can cover larger portions of the blade 134, such as 33%, 50%, or more. The second section 192 then covers the remaining area of the blade 134, extending to the tip 168 for example.

Alternatively, the transition section 194 can begin or end at thirds of the blade 134, at either of the 33% span-wise distance 152 along the span-wise axis 174, or 66% s span-wise distance 154 along the span-wise axis 174. In such an example, either the first section 190 or the second section 192 can cover either 33% or 66% of the blade, while the other of the first section 190 or the second section 192 covers the remaining section unoccupied by the third section 194.

The blade 134 can optionally include a fourth section 196 and a fifth section 198. The fifth section 198 can be arranged at the root 166 and the fourth section 196 can be arranged between the first section 190 and the fifth section 198. The fourth section 196 can include a transitional cross section or profile similar to that of the third sections 94, 194 as described herein, and the fifth section 198 can include a cross section including the flat upper and lower surfaces 162, 164 similar to the second sections 92, 192 as described herein. The fourth section 196 can provide for transitioning between the lifting or airfoil profile of the first section 190 to the flat profile of the fifth section 198. In one non-limiting example, the fourth section 196 can be arranged complementary to the blade iron mount 176, beginning and ending relative to the span-wise extent of the blade iron mount 176. The fifth section 198 can terminate at the root 166.

It should be appreciated that the blade 134 can be separated into three sections, or five sections, while it is further contemplated that the blade 134 can include any number sections which can be arranged in a myriad of different ways. It is preferable that the area occupied by sections having an aerodynamic lifting or airfoil profile is maximized, to maximize aerodynamic benefits, while balancing with sections having the flat upper and lower surfaces to provide a desirable consumer aesthetic and unadorned bottom surface 164. Increasing the length of the transitional sections can provide for some aerodynamic benefit, while maintaining the traditional aesthetic for the fan. Therefore, a balance can be struck between the sizing of the different sections, and the aerodynamic or aesthetic needs of the particular fan or implementation thereof.

Referring now to FIGS. 7-12, six different exemplary aerodynamic lifting or airfoil cross sections or profiles are shown, while it should be understood that the possibilities for airfoil profiles are not limited to just those shown in the figures, but may be a combination thereof or utilizing other features providing an aerodynamic or efficiency benefit. Utilizing the different aerodynamic lifting or airfoil cross sections in combination with a tip having a flat upper surface and a flat lower surface can provide for improved blade efficiency while providing the consumer with a traditional blade aesthetic appearance having an unadorned bottom surface.

Figure 9:
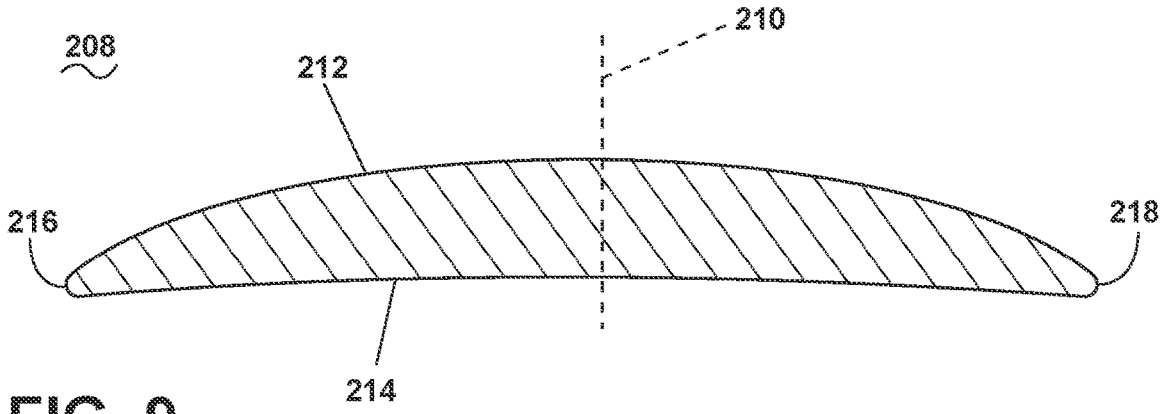
FIG. 9 is a section view of a fan blade having a flat bottom airfoil shape.

Referring now to FIG. 9, an airfoil cross section having a flat bottom airfoil profile 208. The flat bottom airfoil 208 can include an upper surface 212 and a flat lower surface 214 extending between a leading edge 216 and a trailing edge 218. The flat bottom airfoil 208 can be asymmetric about the vertical axis 210 equidistant from the leading and trailing edges 216, 218. The upper surface 212 can have an arcuate, convex shape, for example. The flat lower surface 214 is flat, similar to that of FIGS. 3-5. In one example, a blade having the flat bottom airfoil profile 208 can be arranged at an angle of attack. The enlarged upper surface 212 can provide for generating increased downward force from the blade to increase blade efficiency by increasing total volume flow generated by the flat bottom airfoil 208.

Figure 10:
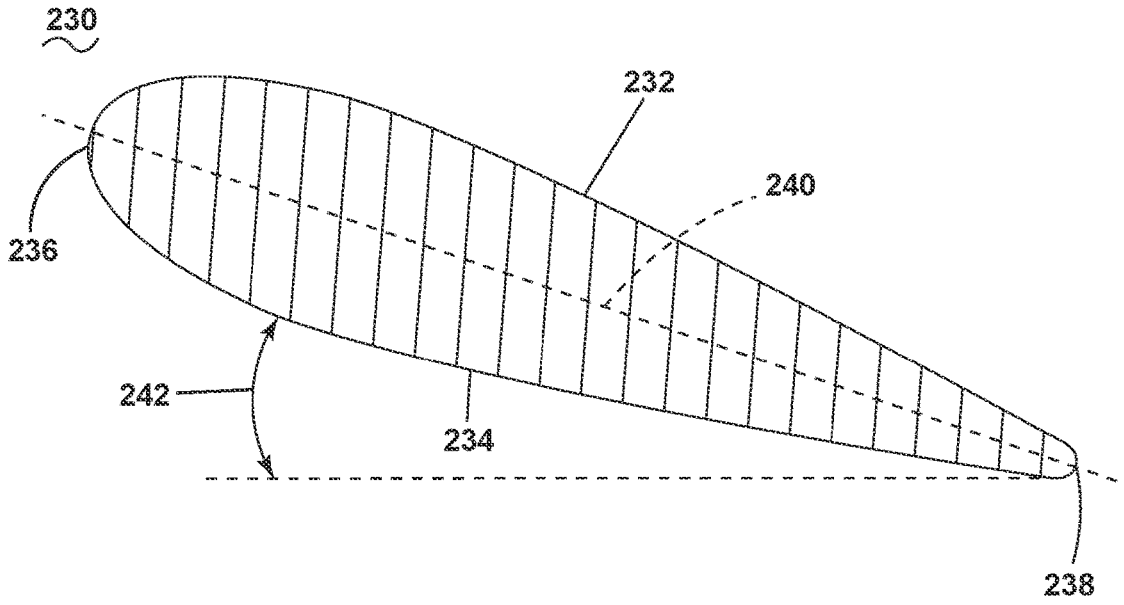
FIG. 10 is a section view of a fan blade having a symmetric airfoil shape.

Referring now to FIG. 10, a cross-sectional profile for a fan blade can be a symmetric airfoil 230, including an upper surface 232 and a lower surface 234, extending between a leading edge 236 and a trailing edge 238 to define a linear chordline 240 extending between the leading edge 236 and the trailing edge 238. The symmetric airfoil 230 can be arranged at an angle of attack 242, for example, orienting the chordline 240 offset from an axis of rotation or a horizontal axis, to increase aerodynamic performance of the symmetric airfoil 230. The symmetric airfoil 230 positioned at the angle of attack 242 can increase the overall downward flow volume generated by the blade, as well as other aerodynamic benefits.

Figure 11:
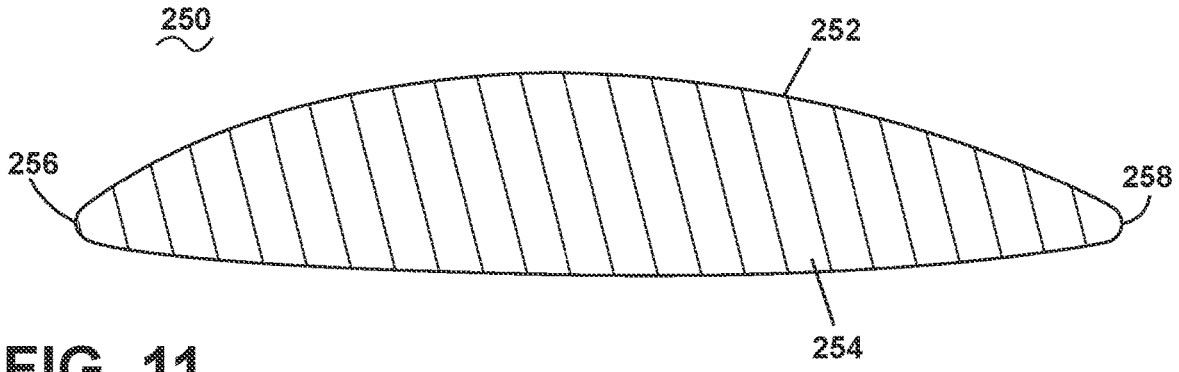
FIG. 11 is a section view of a fan blade having a semi-symmetric airfoil shape.

Referring now to FIG. 11, a cross-sectional profile for a fan blade can include a semi-symmetric airfoil 250. The semi-symmetric airfoil 250 can include an upper surface 252 and a lower surface 254, extending in a chord-wise direction between a leading edge 256 and a trailing edge 258 that has a non-linear chordline between the leading edge 256 and the trailing edge 258. The upper surface 252 and the lower surface 254 can be rounded unevenly, such that one is surface 252, 254 is longer than the other. The semi-symmetric airfoil 250 can be a balance between the flat bottom airfoil of FIG. 9 and the symmetric airfoil of FIG. 10, for example, and can be arranged at an angle of attack to increase flow volume. The semi-symmetric airfoil 250 can increase the overall downward flow volume generated by the blade, as well as other aerodynamic benefits.

Figure 12:
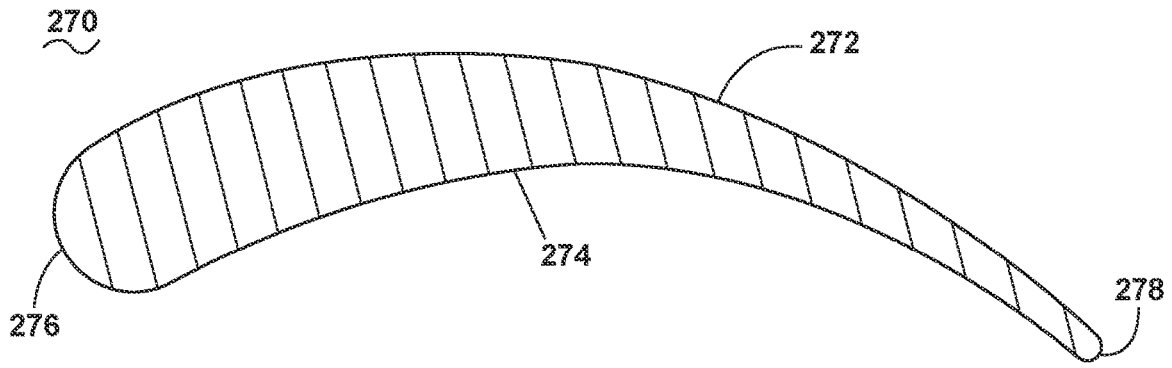
FIG. 12 is a section view of a fan blade having an early airfoil shape with a deep camber.

Referring now to FIG. 12, a profile for a fan blade can be an under-camber airfoil profile 270 including an upper surface 272 and a lower surface 274, and extending between a leading edge 276 and a trailing edge 278. The upper surface 272 can be convex, while the lower surface 274 can be generally concave. The under-camber airfoil 270 can be an early airfoil, having the concavity for the lower surface 274 begin near the leading edge 278. The leading edge 256 and the trailing edge 258 can be rounded or radiused in non-limiting examples, while flat or other geometries are contemplated. The under-camber airfoil 270 can be arranged at an angle or attack, and can provide for increased downward force generated by the blade to improve total flow volume, increasing blade efficiency.

Figure 13:
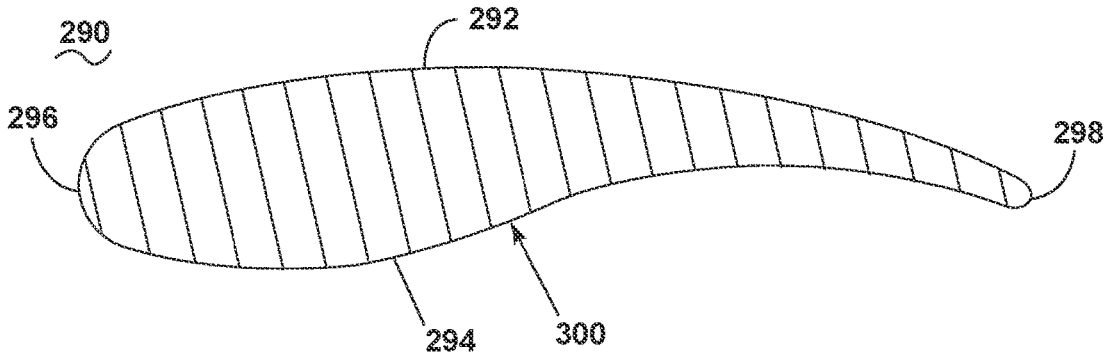
FIG. 13 is a section view of a fan blade having a late airfoil shape.

Referring now to FIG. 13, a profile for another fan blade can be an under-camber airfoil 290 including an upper surface 292 and a lower surface 294, and extending between a leading edge 296 and a trailing edge 298. As compared to FIG. 12, the under-camber airfoil 290 of FIG. 13 is a late airfoil, providing for a concave lower surface 294 that begins further from the leading edge 296, and includes an inflection point 300 nearer to the center of the airfoil 290 between the leading and trailing edges 296, 298. The under-camber airfoil 290 can be arranged at an angle or attack, and can provide for increased downward force generated by the blade to improve total flow volume, increasing blade efficiency.

Figure 14:
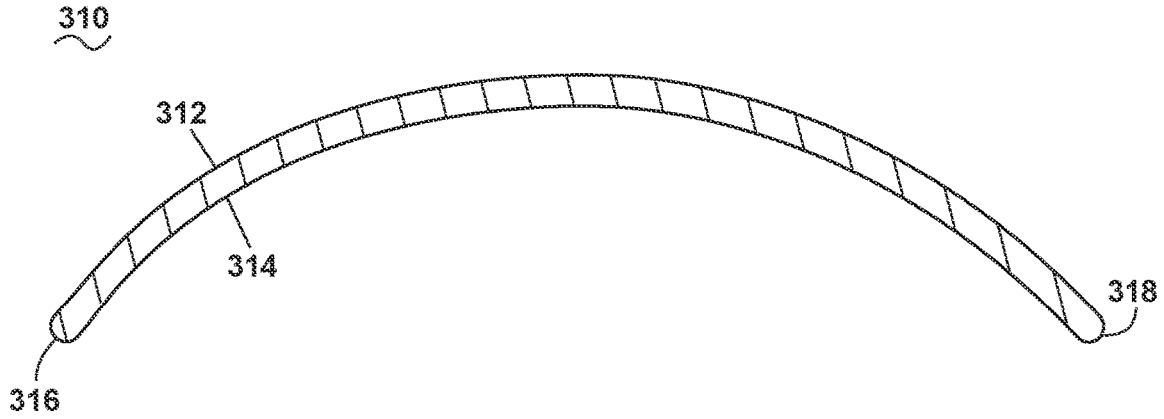
FIG. 14 is a section view of a fan blade having an under-camber airfoil shape with a uniform thickness.

Referring now to FIG. 14, an aerodynamic profile for a fan blade can be another under-camber airfoil 310, including a convex upper surface 312 and a concave lower surface 314, with a leading edge 316 and a trailing edge 318, having a uniform thickness between the upper surface 312 and the lower surface 314. The under-camber airfoil 310 can be arranged at an angle or attack, and can provide for increased downward force generated by the blade to improve total flow volume, increasing blade efficiency.

A lifting or airfoil cross section, portion, or an aerodynamic profile as described herein, such as that of FIG. 2, 3, or 6 showing the first section 90, 190 can include any of the profiles shown in FIGS. 7-12, or any combination of elements thereof, or any other geometry suitable to increase operational efficiency of a ceiling fan due to the aerodynamic section or profile reducing aerodynamic drag, turbulence, or increasing boundary layer attachment along at least a portion of one or more surfaces, as opposed to a traditional profile or blade shape. The tip 68, 168 having the second section 92, 192, of FIG. 2, 4, or 6 provides the consumer with a pleasing, traditional fan blade aesthetic appearance and unadorned bottom surface, while realizing the benefits of the first section 90, 190. Similarly, utilizing a fifth section 198, as shown in FIG. 8 provides for both a tip 168 and a root 166 having the flat upper and lower surfaces 162, 164, which provides for a traditional consumer aesthetic with an unadorned bottom surface when viewing the blade 134 along either the root 166 or the tip 168, while realizing the aerodynamic benefit of the first section 190.

Figure 15:
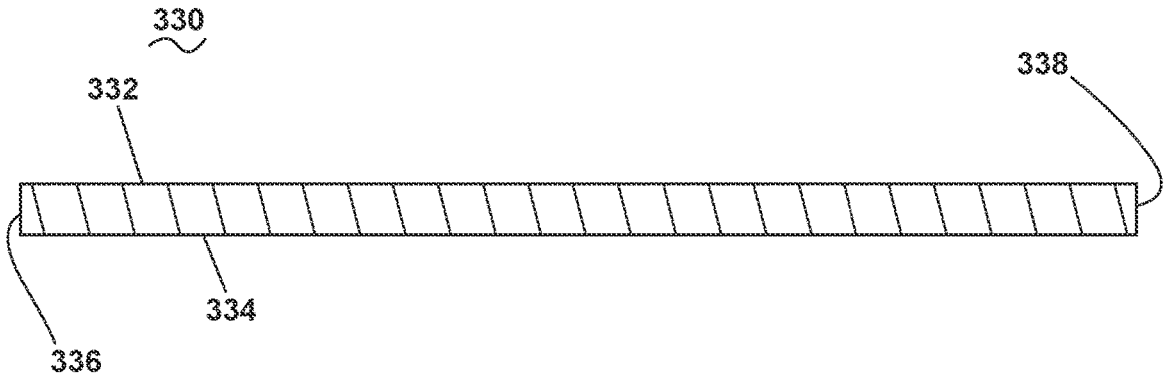
FIG. 15 is a section view of a fan blade having a flat upper surface, a flat lower surface, a flat leading edge, and a flat trailing edge.

Referring now to FIG. 15, a blade cross section 330 can include an upper surface 332 and a lower surface 334, each surface 332, 334 being flat and parallel to one another. A leading edge 336 and a trailing edge 338 can be flat and arranged orthogonal to the upper and lower surfaces 332, 334. Alternatively, it is contemplated that the leading and trailing edges 336, 338 can be rounded or beveled. The blade cross section 330 provides for an aesthetic for a ceiling fan that is appreciable to consumers that consumers are used to seeing in traditional ceiling fans. The blade cross section 330 can be utilized in the second sections 92, 192 as described herein, for example.

Figure 16:
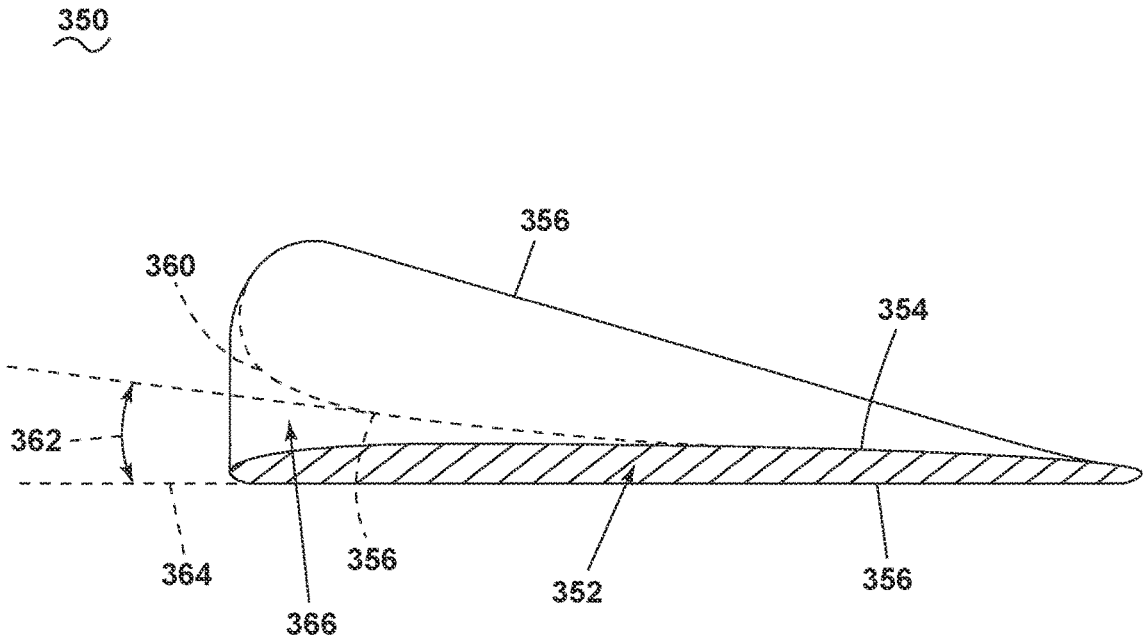
FIG. 16 is a section view of a fan blade having a varying angle of attack to form a twist.

Referring now to FIG. 16 another exemplary blade 350 can include a blade cross section 352, having an upper surface 354 and a lower surface 356 that are parallel to one another. The blade cross section 352 can be arranged at a tip of the blade 350, for example. Additionally, the blade 350 can include an airfoil cross section 360, shown as an exemplary symmetric airfoil (partially in broken line). The airfoil cross section 360 also includes the upper surface 354 and the lower surface 356. The lower surface 356 at the airfoil cross section 360 is arranged at an angle of attack 362, relative to a horizontal axis 364, as well as relative to the lower surface 334 of the blade cross section 352. Thus, the airfoil cross section 360 can be arranged at the angle of attack 362, while the blade cross section 352 is not, to define a twist 366 for the blade 350. In one example, the twist 366 can be positioned at a transition section, such as the third section 94 of FIG. 2. Thus, the airfoil cross section 360 can provide for improved aerodynamic performance at the angle of attack 362, while the blade cross section 352 remains in a visibly flat position aesthetically pleasing to the consumer.

The blades and sections thereof as described herein provide for both increased total flow volume for a ceiling fan, resulting in increased efficiency, while maintaining the aesthetic appearance having an unadorned bottom surface of a ceiling fan that consumers desire. More specifically, the airfoil cross section provides for increased downward force on air which increases the total volume of airflow, while the flat upper and lower surfaces of the blade match traditional fan blade styles. Additionally, the third section provides for a smooth transition between the airfoil section and the blade section, which minimizes losses, while provides for an aesthetically appealing transition between the sections.

To the extent not already described, the different features and structures of the various features can be used in combination as desired. That one feature is not illustrated in all of the aspects of the disclosure is not meant to be construed that it cannot be, but is done for brevity of description. Thus, the various features of the different aspects described herein can be mixed and matched as desired to form new features or aspects thereof, whether or not the new aspects or features are expressly described. All combinations or permutations of features described herein are covered by this disclosure.

This written description uses examples to detail the aspects described herein, including the best mode, and to enable any person skilled in the art to practice the aspects described herein, including making and using any devices or systems and performing any incorporated methods. The patentable scope of the aspects described herein are defined by the claims, and can include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A blade driven by a ceiling fan having a fan motor, the blade comprising:

a body extending between a leading edge and a trailing edge to define a chord-wise direction, and extending between a root and a tip to define a span-wise direction, with the body including an upper surface and a lower surface;

wherein the body comprises at least three distinct cross sections including a first cross section having a flat lower surface with an airfoil cross section, a second cross section comprising a flat lower surface and a flat upper surface; and a third cross section located between and transitioning from the first to the second cross sections.

2. The blade of claim 1 wherein the flat lower surface of the first cross section and the second cross section are shared.

3. The blade of claim 1 wherein the second cross section is provided at the tip and the first cross section is spaced from the tip.

4. The blade of claim 3 wherein the first cross section extends from the root.

5. The blade of claim 4 wherein the second cross section extends from the tip.

6. The blade of claim 5 wherein the third cross section is different from the first cross section and the second cross section.

7. The blade of claim 1 wherein the airfoil cross section is one of a flat bottom airfoil or a semi-symmetrical airfoil.

8. The blade of claim 1 wherein the first cross section and the second cross section are taken in the chord-wise direction.

9. The blade of claim 1 wherein the tip includes a front surface having a convex shape.

10. The blade of claim 9 wherein the root includes a rear surface that is flat.

11. The blade of claim 1 further comprising a blade iron mount provided on the body at the root.

12. The blade of claim 11 wherein the blade iron mount is a gasket.

13. The blade of claim 11 wherein the blade iron mount is provided on the lower surface of the body.

14. A blade for a ceiling fan comprising:

a body including an upper surface and a lower surface, wherein the body comprises a first cross section with a flat lower surface with an airfoil cross section, a second cross section with a flat upper surface and the flat lower surface, and a third cross section located between and transitioning from the first to the second cross sections.

15. The blade of claim 14 wherein the flat lower surface is common with the first cross section and the second cross section.

16. The blade of claim 14 wherein the first cross section is provided at a root of the blade and the second cross section is provided at a tip of the blade.

17. The blade of claim 16 wherein the second cross section extends from the tip toward the root.

18. A ceiling fan comprising:

a motor;

a blade rotatably driven by the motor, the blade including an airfoil body having an outer surface extending between a leading edge and a trailing edge to define a chord-wise direction, extending between a root and a tip to define a span-wise direction, and separating the outer surface into an upper surface and a lower surface;

wherein the airfoil body comprises a first cross section comprising an airfoil cross section, a second cross section comprising a flat upper surface and a flat lower surface, and a third cross section located between and transitioning from the first to the second cross sections.

19. The ceiling fan assembly of claim 18 wherein the second cross section extends from the tip.

20. The ceiling fan assembly of claim 18 wherein the third cross section different than the first cross section and the second cross section.

21. The blade of claim 2 wherein the shared flat lower surface of the first and second cross sections is share with the third cross section to form a common flat lower surface.

22. The blade of claim 21 wherein the common flat lower surface has a twist about an axis extending in the span-wise direction.

23. The blade of claim 22 wherein is the twist is limited to the third section.

* * * * *